United States Patent [19]

Bozich

[11] 4,078,843

[45] Mar. 14, 1978

[54] HANDLE CONSTRUCTION

[75] Inventor: Robert A. Bozich, Eveleth, Minn.

[73] Assignee: Malton Electric Company, Virginia, Minn.

[21] Appl. No.: 638,753

[22] Filed: Dec. 8, 1975

[51] Int. Cl.[2] ..... E05C 5/00

[52] U.S. Cl. ..... 292/57; 292/206; 292/DIG. 30

[58] Field of Search ..... 292/336.3, 202–212, 292/DIG. 30, DIG. 31, 57–59; 70/78

[56] References Cited

U.S. PATENT DOCUMENTS

| | | | |
|---|---|---|---|
| 748,078 | 12/1903 | Kaisling | 292/251 |
| 1,128,329 | 2/1915 | Kilmer | 292/268 |
| 1,488,590 | 4/1924 | Fellman | 292/338 |
| 1,774,141 | 8/1930 | Hills | 292/251 |
| 2,785,917 | 3/1957 | Reed | 292/202 |
| 2,912,271 | 11/1959 | Schaefer | 292/336.3 |
| 3,039,837 | 6/1962 | Poe | 292/DIG. 30 |
| 3,784,727 | 1/1974 | Haubein | 292/251 |
| 3,851,942 | 12/1974 | Clay et al. | 292/205 |

*Primary Examiner*—Paul R. Gilliam
*Assistant Examiner*—Kenneth J. Dorner
*Attorney, Agent, or Firm*—Merchant, Gould, Smith, Edell, Welter & Schmidt

[57] ABSTRACT

A door and handle latch for apparatus enclosures includes a recessed handle latch on the door which serves to immovably secure the door to the enclosure structure by engaging a portion of the enclosure when the handle latch is in the closed position. A bolt means is provided in the lower portion of the handle latch to secure the handle latch to the door in a closed position, thus, preventing opening of the enclosure.

9 Claims, 9 Drawing Figures

HANDLE CONSTRUCTION

BACKGROUND

1. Field of the Invention

The present invention generally concerns a door and handle construction and more specifically concerns a door and handle latch assembly for securing apparatus enclosures.

2. Prior Art

In various apparatus enclosures, such as standard metal transformer enclosures, it is necessary to provide an access door for servicing the equipment therein. The access doors also serve to prevent unauthorized tampering with the equipment. Hence, access doors have been provided with a variety of locks and handles for security.

Standard handles which are exposed to and protrude from the surface of the enclosures can often be broken away by a single blow from a heavy object. Where the handle is not completely broken away, it is often damaged to the extent that it becomes nonfunctional and requires dissassembly of the enclosure to effect repairs.

Therefore, a need exists for a handle and lock construction which provides for a secure enclosure. Recessing the handle within the door and adding locking features to the recessed handle provides a superior construction for this type of an enclosure. The present invention is directed to such an enclosure.

SUMMARY OF THE INVENTION

The present invention is a novel closure door and handle latch for apparatus enclosures which includes a door having a recess formed therein. The recess includes a hinge slot through which a handle latch is insertable. The handle latch is described by an elongated back portion which extends through the hinge slot and is engageable with an interior surface portion of the closure housing. The handle latch, which is pivotal in the recess between latching and release positions, further includes a lower grip portion which is continuous with the back portion. Finally, there is included a means for releasably engaging the handle latch to the door in the latching position.

DETAILED DESCRIPTION OF THE DRAWINGS

Figure 1:
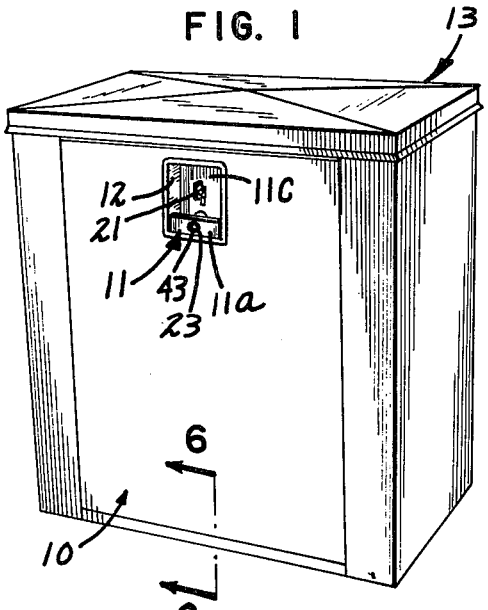
FIG. 1 is a view in perspective of the present invention on a typical equipment enclosure.

Referring first to FIG. 1, there is shown generally an apparatus enclosure 13 of a type similar to standard metal transformer enclosures. However, it is readily apparent that the enclosure as described herein can serve a variety of purposes.

Figure 3:
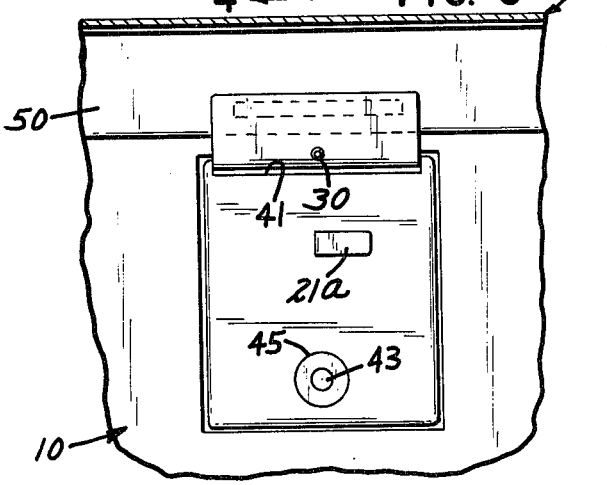
FIG. 3 is an enlarged fragmentary rear view of the portion shown in FIG. 2.

In the first embodiment, the apparatus enclosure 13, as described herein, is generally rectangular with a removable door 10 forming a substantial portion of one side thereof. Enclosure door 10 can also be of the type which is not completely removable but is retained on the enclosure by swing hinges (not shown). Door 10 has a recess 12 formed therein near the top of the enclosure housing. The recess 12 is defined by a back wall, a top wall, a bottom wall, and side walls. A lock hasp 21 is carried on the back wall of recess 12 and is sized to accommodate a standard lock 25. Lock hasp 21 is secured to recess 12 by tab 21*a*, as shown in FIG. 3, which is inserted through a hole in the back wall of recess 12 and is bent generally at a right angle thereto. A spot weld will serve to secure the lock hasp 21 to recess 12.

Figure 4:
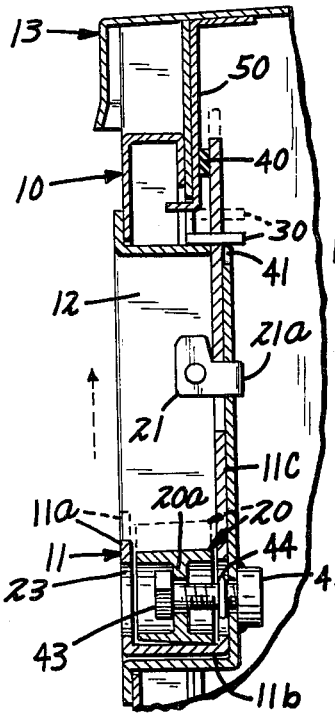
FIG. 4 is a fragmentary view in cross section taken along lines 4—4 of FIG. 2.
Figure 5:
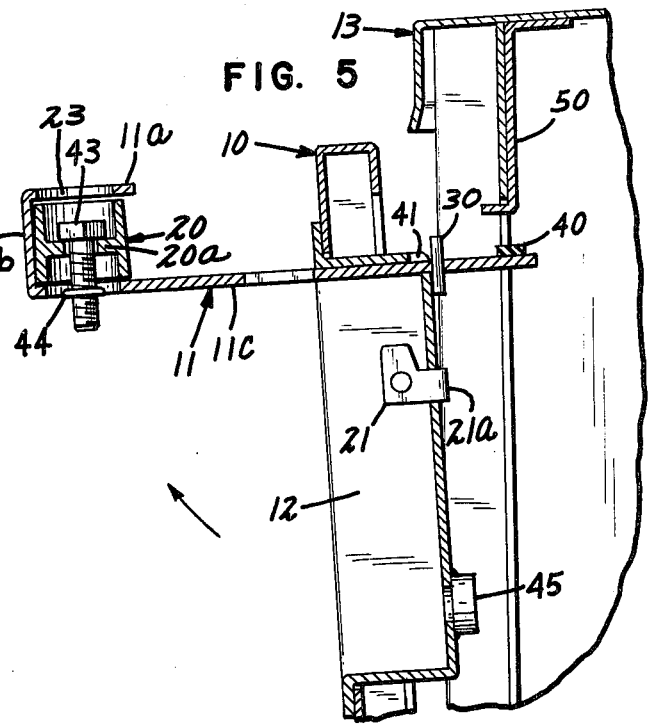
FIG. 5 is a view similar to FIG. 4 showing a different position of the parts thereof.

Inside recess 12 is a handle latch 11 which includes an elongated back portion and a hand grip portion. Handle latch 11 of this embodiment has an elongated upwardly extending back portion 11*c*, a forwardly extending bottom portion 11*b*, and a relatively short upwardly extending front portion 11*a* defining the hand grip portion. The general dimensions of handle latch 11 are such that it substantially covers the back wall and the bottom wall of recess 12. Therefore, front portion 11*a* of handle latch 11 is generally flush with the surface of the enclosure door 10. Elongated back portion 11*c* includes a latch slot therein which is alignable with the offset tab portion lock hasp 21 on recess 12 and is of sufficient dimension to permit lock hasp 21 to readily pass therethrough as shown in FIG. 4. The back portion 11*c* extends upwardly through a hinge slot 41 in a recess 12 which is formed along the corner where the back wall and the top wall meet in recess 12. Handle latch 11 is pivotal in slot 41 between two positions: a closed or latching position as shown in FIG. 4 and an open or release position as shown in FIG. 5. A roll pin 30 is secured to handle latch 11 just above slot 41, which prevents complete removal of handle latch 11 from recess 12. The back portion 11*c* includes a spacer seal 40 near its upper most end which is engageable with a fixed downwardly extending front wall portion 50 of apparatus enclosure 13 when the handle latch is in the closed position. In this closed position, the enclosure door is securely latched to the apparatus enclosure 13 by the engagement of the upper end of back portion 11*c* of handle latch 11 and the front wall portion 50 of the apparatus enclosure 13. To open the door, handle latch 11 swings up and pivots out of recess 12, as shown generally in FIG. 5, such that the upper end of back portion 11*c* is clear of the front wall portion 50 and in a generally perpendicular position with respect to the enclosure door 10. At this time, the door 10 can be completely removed to provide access to the equipment inside the enclosure 13. As stated previously, the door can be hinge mounted, along one side thereof, to the apparatus enclosure and will swing open but will not be completely removable therefrom. When the door 10 is completely removable. as herein described, it is retained in the closed position by engagement of a downwardly extending flange 10*a* on door 10 and an upwardly extending flange 13*a* along the apparatus enclosure 13 which is positioned on the side of enclosure door 10 which is opposite to the positioning of the handle latch 11 thereon.

The handle latch 11 includes a bolt means, being positioned behind the front portion 11*a* of handle latch 11, which functions to secure the handle latch 11 in a closed position. As shown in FIG. 4, a bolt 43 is carried by a bolt sleeve casting 20. The bolt sleeve casting 20 is generally cylindrical in shape and is positioned within the "U-shaped" channel formed by the front portion 11*a*, back portion 11*b*, and the lower back portion 11*c* of handle latch 11. The bolt 43 is inserted through a hole in the central plate portion 20*a* of sleeve casting 20. Access to the bolt 43 is provided by a hole or port 23 in the front portion 11*a* of handle latch 11. The hole 23 has a diameter which is sufficient to provide for insertion of an elongated socket-type wrench therethrough to engage the head of bolt 43. Further, the head of bolt 43 can be a nonstandard type, such as the penta-bolt head herein shown, to prevent removal of bolt 43 by standard type wrenches.

In order to prevent complete extraction of bolt 43, a bolt keeper is inserted over the threaded portion of bolt 43 and is carried thereon between the central plate 20*a* and the back wall portion 11*c* of handle latch 11. The diametrical size of bolt keeper 44 is greater than the diameter of the bolt hole in central plate 20*a*, thus, preventing complete extraction of bolt 43 from the sleeve casting 20.

To secure the bolt 43 to the recess 12, it is inserted through a second bolt hole in the lower back wall portion 11*c* of handle latch 11, which is aligned with the bolt hole through central plate 20*a* of sleeve casting 20. A first bolt hole extends through the back wall of recess 12. On the backside of recess 12, directly behind the bolt hole therein, there is a captivated nut 45, which is threadably engageable with bolt 43. The captivated nut 45 is secured to the back of recess 12 by any suitable manner such as a spot weld or the like. When bolt 43 and captivated nut 45 are engaged, the handle latch 11 is secured in its closed position and the door 10 will not open.

In summary, the handle latch of the first embodiment operates as follows: the lock 25, if used, is removed from lock hasp 21. A wrench, or similar tool, is inserted into hole 23 on the front portion 11*a* of handle latch 11 and the nut 43 is reversed rotated until it is free of the captivated nut 45 on the back of recess 12. The bolt 43 is kept in the sleeve casting 20, by the bolt keeper 44. Once the bolt is free of the nut 45, the handle latch can be moved upwardly to allow the latch slot to clear hasp 21, and will swing out and up pivotally against roll pin 30 along slot 41 in recess 12. When the elongated portion 11*c* of handle latch 11, which extends through slot 41, is moved clear of its engagement with the downwardly extending front wall portion 50 of enclosure 13, the door 10 will be free to swing open.

Figure 2:
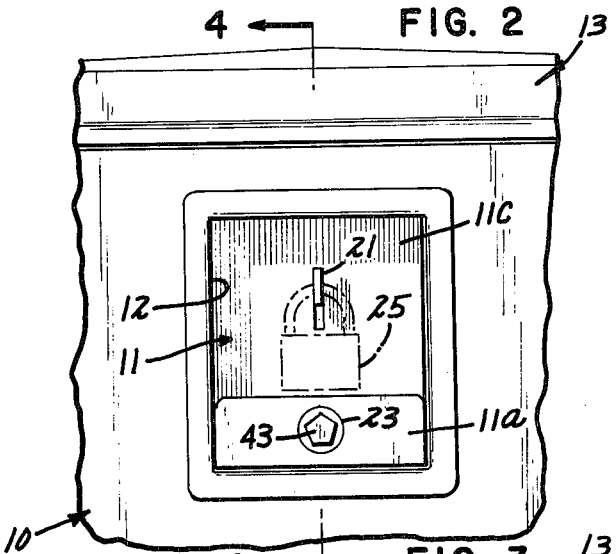
FIG. 2 is an enlarged fragmentary view of a portion of FIG. 1.
Figure 6:
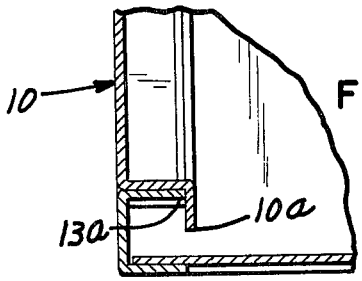
FIG. 6 is an enlarged fragmentary view of a portion of the enclosure viewed along line 6—6 of FIG. 1.
Figure 7:
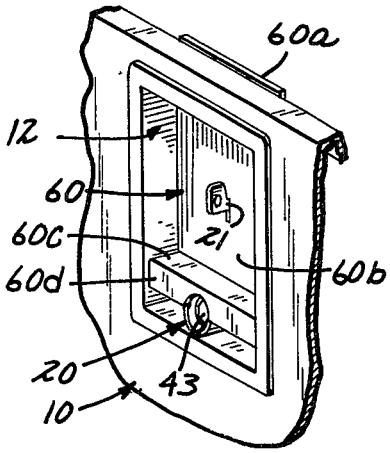
FIG. 7 is a fragmentary view, in perspective, of a second embodiment of the present invention.
Figure 8:
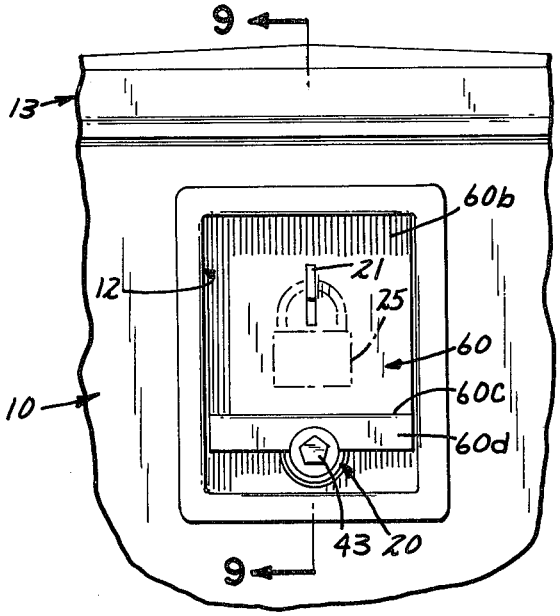
FIG. 8 is an enlarged fragmentary frontal view of FIG. 7.

A second embodiment of the present invention involves a variation in the construction of the handle latch and hand grip portion. Referring to FIG. 7, there is shown a view in perspective of a second embodiment of the present invention. In this embodiment, the handle latch 11 of FIG. 2 is modified in construction to form an alternate handle latch 60. The handle latch 60 includes an elongated back portion 60*b* and a forwardly extending portion 60*c* which extends perpendicularly outwardly from the bottom of the back portion 60*b*. The handle latch 60 also includes a downwardly extending portion 60*d* which extends perpendicularly downward from the forward edge of the outwardly extending portion 60*c*. The two portions 60*c* and 60*d* define the hand grip portion of this embodiment. Downwardly extending portion 60*d* includes a cut out portion thereon which conforms to the size and configuration of the bolt sleeve casting 20. Downwardly extending portion 60*d* does not extend all the way down to the bottom wall of recess 12, but rather terminates approximately one half the way down along the bolt sleeve casting.

Whereas the configuration of the hand grip portion of handle latch 11 of the first embodiment is generally "U-shaped" the general configuration of the hand grip portion of handle latch 60 of this embodiment is an "inverted channel".

Figure 9:
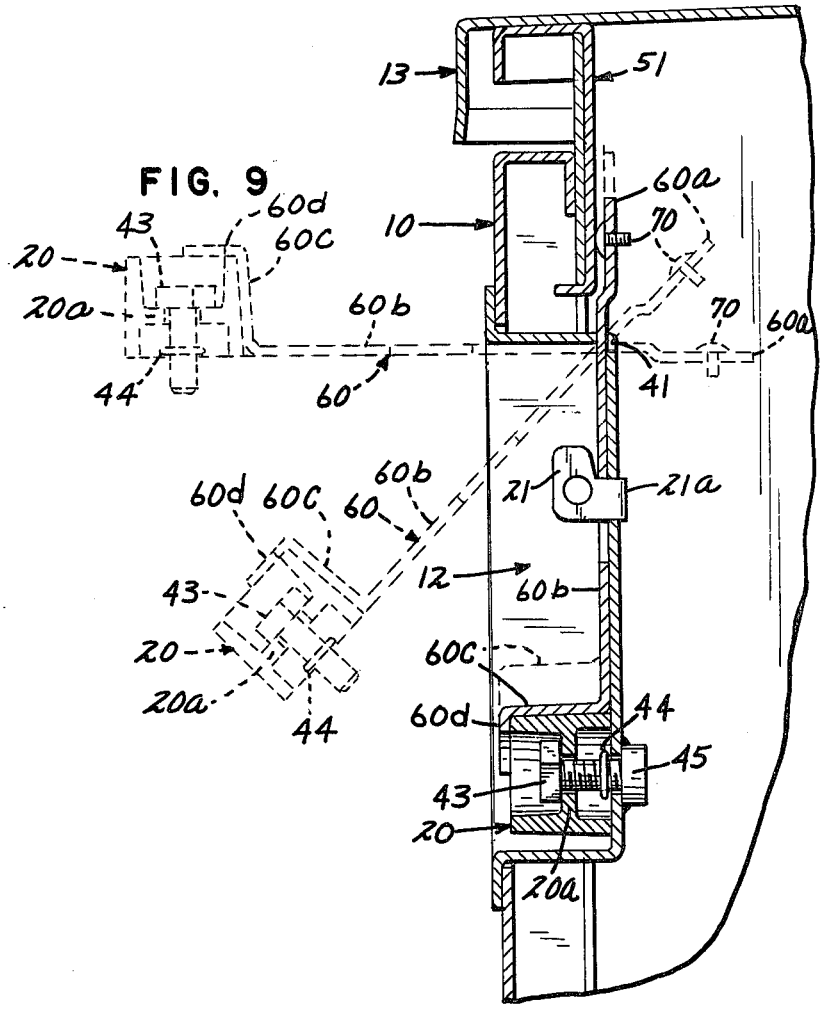
FIG. 9 is a fragmentary view in cross section taken along the lines 9—9 of FIG. 8.

As seen in FIG. 9, the upper portion of the handle latch 60 is bent slightly inward to form the upper portion 60*a*. Whereas the elongated portion 11*c* of the handle latch of FIG. 5 is straight and includes a roll pin 30 thereon to keep the handle latch 11 within hinge slot 41, the upper portion 60*a* of the handle latch 60*a* in FIG. 9 achieves the same function without the roll pin 30. The bend in the upper portion 60*a* is just sufficient to prevent the handle latch 60 from being completely extracted from the hinge slot 41. In this embodiment, the spacer seal 40 of FIG. 5 of the first embodiment is replaced by a round head metal screw 70 which serves the same function as spacer seal 40. The bolt sleeve casting 20 and its internal bolt means 43 is identical to that of the first embodiment. Further, the operation of the handle latch of the second embodiment is essentially identical to the operation of the handle latch of the first embodiment.

Thus, it is apparent that the present invention provides a superior handle and latch construction for apparatus enclosures. It is further apparent that various changes and modifications in the illustrative embodiment of the present invention, shown and described herein, can be made without departing from the scope of the invention as defined in the appended claims.

What is claimed is:

1. A closure door and handle latch for apparatus enclosures, comprising:

(a) a door having a recess formed therein, said recess including a hinge slot;

(b) a handle latch within said recess having:

(i) a back portion within elongated upper end which extends through said hinge slot, where it is engageable with a portion of the enclosure, said handle latch being movable therein between latching and release positions; and (ii) a lower portion, continuous with said back portion, which defines a hand grip portion; and (c) means for releasably engaging said handle latch to said door in the latching position including a latch hasp having a tab portion on said door said latch hasp being engageable with said handle latch through a latch slot in said handle latch, wherein said latch slot is offset from said tab portion of said latch hasp in the latching position, and wherein the handle latch is movable to align the latch slot with the tab portion of the latch hasp before the handle latch is pivotable to the release position.

2. The door and handle latch of claim 1 in which said hand grip portion on said lower portion of said handle latch is generally U-shaped.

3. The door and handle latch of claim 1 in which said hand grip portion on said lower portion of said handle latch is generally as an inverted channel.

4. The door and handle latch of claim 1 in which said means for releasably engaging said handle latch further comprises a bolt means on said handle latch in said lower portion and a captivated nut on said door which is threadably engageable with said bolt means.

5. The door and handle latch of claim 1 which includes means for preventing complete removal of said handle latch from said hinge slot, said means comprising a roll pin extending through said elongated upper end of said back portion.

6. Closure door and handle latch for apparatus enclosures comprising:

(a) a closure door having a recess formed therein, said recess having a back wall with a first bolt hole therethrough, a top wall, a bottom wall, and side walls, and including a hinged slot formed between and along said top wall and said back wall;

(b) a lock hasp on said back wall;

(c) a captivated nut on said back wall adjacent to the first bolt hole; and (d) a handle latch pivotable between latching and release positions within said recess, said handle latch having:

(i) an elongated upwardly extending back portion thereof which extends through said hinge slot at the top of said recess for latching engagement with said enclosure, a forwardly extending lower portion, adjacent to said bottom wall and a shorter upwardly extending bottom portion thereof, said front portion of said handle latch not extending beyond the forward edge of said recess of said door;

(ii) a bolt retaining means, having a bolt therein fastened between said shorter front portion and said back portion;

(iii) said front portion having a port therethrough to provide access to said bolt;

(iv) said back portion having a second bolt hole therethrough alignable with said first bolt hole in said back wall of said recess, said bolt extending through said aligned first and second holes in the latching position for engagement with said nut;

(v) said back portion having a hasp slot thereon which is engageable with said lock hasps along said back wall of said recess in the latching position of said handle latch; and (vi) a roll pin inserted through said handle latch above said hinge slot to hold said handle latch in said hinge slot when said handle latch is pivoted outwardly to the release position.

7. The apparatus of claim 6 wherein said back wall of said recess is generally rectangular in shape, wherein said back portion of said handle latch is a generally rectangular plate sized to cover said back wall, wherein said lower portion is a generally rectangular plate sized to cover said bottom wall, and wherein said front portion is a generally rectangular plate having its outside surface generally flush with the outside surface of the door in the latching position.

8. The apparatus of claim 6 in combination with an enclosure having an opening in a wall thereof covered by said closure door, said recess being positioned adjacent one edge of said opening and extending into the opening beyond the plane of said enclosure wall, said upwardly extending back portion of said handle latch being positioned directly behind said wall in the latching position to hold said door closed.

9. Closure door and handle latch for apparatus enclosures, comprising:

(a) a closure door having a recess formed therein, said recess having a back wall with a first bolt hole therethrough, a top wall, a bottom wall, and side walls, and including a hinge slot formed between and along said top wall and said back wall;

(b) a lock hasp on said back wall;

(c) a captivated nut on said back wall adjacent to the first bolt hole through said back wall; and (d) a handle latch pivotable between latching and release positions within said recess, said handle latch having:

(i) an elongated upwardly extending back portion thereof which extends through said hinge slot at the top of said recess for latching engagement with said enclosures, an outwardly extending portion extending generally perpendicularly outward from said elongated back portion being continuous with said back portion, and a downwardly extending portion extending generally perpendicularly downward from the forward edge of said outwardly extending portion being continuous with said outwardly extending portion; and (ii) a bolt retaining means, having a bolt therein, fastened to said handle latch and being alignable with said captivated nut on said back wall.

* * * * *